US009541878B2

(12) United States Patent
Kwon

(10) Patent No.: US 9,541,878 B2
(45) Date of Patent: Jan. 10, 2017

(54) PRINTING MEDIUM SUPPLYING APPARATUS AND IMAGE FORMING APPARATUS HAVING THE SAME

(71) Applicant: SAMSUNG ELECTRONICS CO., LTD., Suwon-si, Gyeonggi-do (KR)

(72) Inventor: Myung Sik Kwon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/596,643

(22) Filed: Jan. 14, 2015

(65) Prior Publication Data

US 2015/0205250 A1 Jul. 23, 2015

(30) Foreign Application Priority Data

Jan. 17, 2014 (KR) ..... 10-2014-0005791

(51) Int. Cl.
*B65H 1/00* (2006.01)
*G03G 15/00* (2006.01)

(52) U.S. Cl.
CPC ..... *G03G 15/6502* (2013.01)

(58) Field of Classification Search
CPC ..... B65H 1/027; B65H 1/266; B65H 1/04; B65H 1/14; B65H 1/30; B65H 1/022; B65H 1/025; B65H 1/08; B65H 2405/31; B65H 2405/32; B65H 2405/35; G03G 21/1623
USPC ..... 271/162, 157, 147, 145
See application file for complete search history.

(56) References Cited

U.S. PATENT DOCUMENTS 5,152,517 A * 10/1992 Ruch ..... B65H 1/04 271/162
5,253,015 A * 10/1993 Morita et al. ..... 399/13
7,648,135 B2 * 1/2010 Matsushima ..... 271/171

* cited by examiner

*Primary Examiner* — Thomas Morrison
(74) *Attorney, Agent, or Firm* — Staas & Halsey LLP

(57) ABSTRACT

An image forming apparatus may include a main body having a developing apparatus, a driving source configured to generate power in the main body, a driven unit configured to receive the power from the driving source to be operated, a supply cassette configured to be detachable from the main body and in which printing media are stacked, and an opening/closing unit configured to receive power from the driving source configured to drive the driven unit to move the supply cassette back and forth. Accordingly, the supply cassette can be automatically opened and closed to provide user convenience.

14 Claims, 13 Drawing Sheets

PRINTING MEDIUM SUPPLYING APPARATUS AND IMAGE FORMING APPARATUS HAVING THE SAME

CROSS-REFERENCE TO RELATED APPLICATIONS

This application claims the priority benefit of Korean Patent Application No. 10-2014-0005791, filed on Jan. 17, 2014 in the Korean Intellectual Property Office, the disclosure of which is incorporated herein by reference.

BACKGROUND

1. Field

Embodiments relate to a printing medium supplying apparatus and an image forming apparatus having the same, and more particularly, to a printing medium supplying apparatus having an automatic opening/closing structure, and an image forming apparatus having the same.

2. Description of the Related Art

In general, an image forming apparatus is an apparatus for forming an image on a printing medium according to an input signal, and may be a printer, a copier, a fax machine, a multi-functional printer implemented by integrating functions thereof, and so on.

Such an image forming apparatus has a printing medium supplying apparatus configured to supply a printing medium. Conventionally, the printing medium supplying apparatus picks up stacked printing media one by one to supply the printing medium to a main body of an image forming apparatus.

The printing medium supplying apparatus includes a supply cassette in which a plurality of printing media is to be supplied to the image forming unit, and a knock-up plate installed at the supply cassette to be elevated.

However, when the supply cassette is manually opened and closed, the supply cassette may be broken or the stacked printing media may become disordered when an impact is large.

SUMMARY

In an aspect of one or more embodiments, there is provided a printing medium supplying apparatus having an improved structure capable of automatically opening and closing a supply cassette, and an image forming apparatus having the same.

In an aspect of one or more embodiments, there is provided an image forming apparatus includes a main body having a developing apparatus; a driving source configured to generate power within the main body; a driven unit configured to receive the power from the driving source to be operated; a supply cassette configured to be detachable from the main body and in which printing media are stacked; and an opening/closing unit configured to receive power from the driving source configured to drive the driven unit, and configured to move the supply cassette back and forth.

The image forming apparatus may further include an opening/closing power control apparatus configured to control power transmitted from the driving source to the opening/closing unit.

The image forming apparatus may further include a power control apparatus configured to intermittently transmit power from the driving source to the driven unit, wherein the power control apparatus and the opening/closing power control apparatus are alternatively operated.

The driven unit may include a knock-up plate configured to elevate the printing medium in the supply cassette.

The image forming apparatus may further include a power control apparatus configured to intermittently transmit power from the driving source to the driven unit, wherein the supply cassette is configured to be movable between a first position of insertion into the main body and a second position of separation from the main body to stack the printing media, and the power control apparatus controls power to the driven unit when the supply cassette is at the first position.

The supply cassette may be configured to be movable between a first position of insertion into the main body and a second position of separation from the main body to stack the printing media, and the opening/closing power control apparatus may control power to the opening/closing unit such that the supply cassette is movable between the first position and the second position.

The opening/closing unit may include a guide unit extending from a side surface of the supply cassette in a first axis (w1) direction parallel to an forward/rearward direction to be rotated; and a guide rail formed at an outer surface of the guide unit in a spiral shape and configured to guide movement of the supply cassette through rotation of the guide unit.

The supply cassette may include a movable protrusion protruding to move along the guide rail.

The supply cassette may be configured to be movable between a first position of insertion into the main body and a second position of separation from the main body, and the guide rail guides the movable protrusion such that the supply cassette is movable between the first position and the second position.

The opening/closing unit may further include a movement detecting sensor provided on the guide unit and configured to detect opening/closing of the supply cassette.

In an aspect of one or more embodiments, there is provided an image forming apparatus includes a main body having a developing apparatus; a driven unit configured to be operated in the main body; a supply cassette configured to be detachable from the main body and in which printing media are stacked; an opening/closing unit configured to move the supply cassette back and forth to open and close the supply cassette; and a driving unit configured to operate the driven unit and the opening/closing unit, wherein the driving unit includes a driving source configured to generate power; a first power control apparatus configured to transmit the power from the driving source to the driven unit; and a second power control apparatus configured to transmit the power from the driving source to the opening/closing unit.

The supply cassette may be provided to be movable between a first position of insertion into the main body and a second position of separation from the main body, and the first power control apparatus may be operated to transmit power to the driven unit when the supply cassette is at the first position.

The supply cassette may be provided to be movable between a first position of insertion into the main body and a second position of separation from the main body to stack printing media, and the second power control apparatus may be configured to transmit power to the opening/closing unit such that the supply cassette is movable between the first position and the second position.

The first power control apparatus and the second power control apparatus may be alternatively operated.

In an aspect of one or more embodiments, there is provided a printing medium supplying apparatus provided to be separable from a main body to supply printing media, the printing medium supplying apparatus including: a supply cassette provided to be movable between a first position of insertion into the image forming apparatus and a second position of separation from the image forming apparatus to stack the printing media; a driving unit having a driving source configured to generate power and an opening/closing power control apparatus configured to selectively transmit power from the driving source; and an opening/closing unit configured to selectively receive power by the opening/closing power control apparatus and configured to move the supply cassette between the first position and the second position.

The printing medium supplying apparatus may further include a knock-up plate configured to elevate the printing medium stacked on the supply cassette, wherein the driving unit further comprises an elevation power control apparatus configured to receive power from the driving source to elevate the knock-up plate.

The opening/closing unit may include a guide unit extending from a side surface of the supply cassette in a first axis (w1) direction parallel to an forward/rearward direction to be rotated; and a guide rail formed on an outer surface of the guide unit in a spiral shape and configured to guide movement of the supply cassette by rotation of the guide unit.

The supply cassette may include a movable protrusion protruding to move along the guide rail.

The supply cassette may be provided to be movable between the first position of insertion into the main body and the second position of separation from the main body to stack the printing media, and the guide rail may guide the movable protrusion such that the supply cassette is movable between the first position and the second position.

The opening/closing unit may further include a movement detecting sensor provided on the guide unit and configured to detect opening/closing of the supply cassette.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
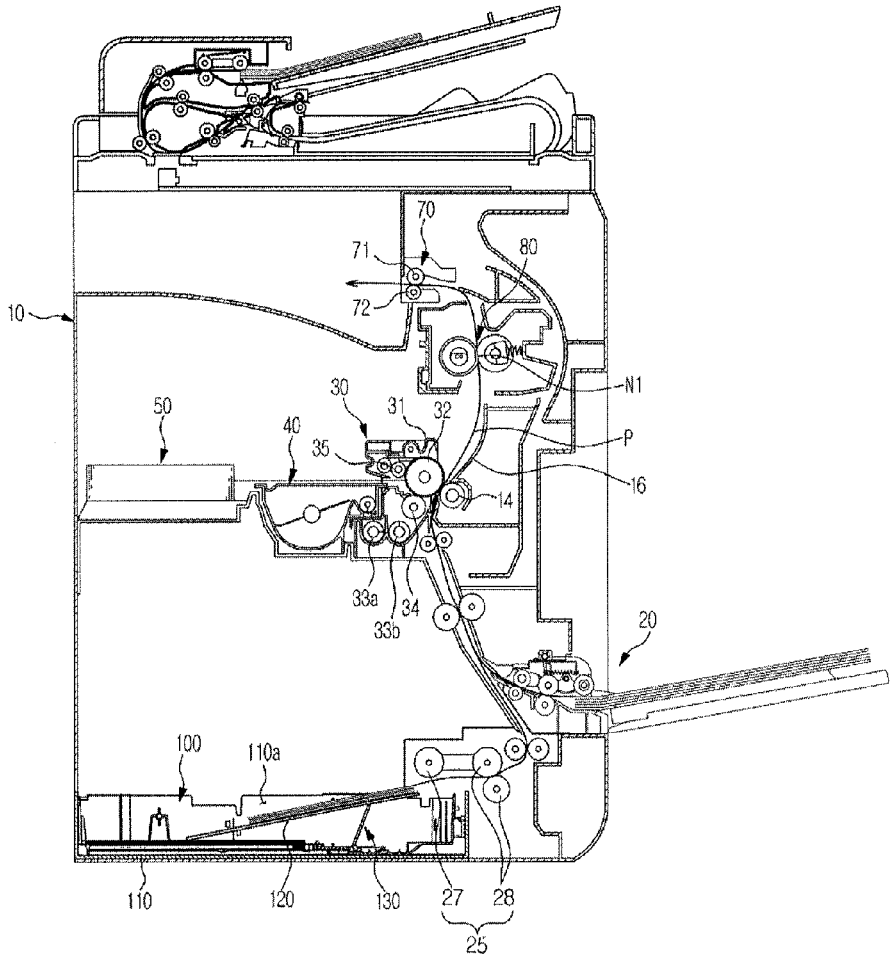
FIG. 1 is a cross-sectional view of an image forming apparatus according to an embodiment.

Reference will now be made in detail to embodiments, examples of which are illustrated in the accompanying drawings, wherein like reference numerals refer to like elements throughout.

FIG. 1 is a cross-sectional view of an image forming apparatus according to an embodiment.

As shown in FIG. 1, an image forming apparatus 1 includes a main body 10, printing medium supplying apparatuses 20 and 100 configured to store and feed a printing medium S, a developing apparatus 30 configured to form an image on the printing medium S supplied through the printing medium supplying apparatuses 20 and 100, a toner apparatus 40 configured to supply toner to the developing apparatus 30, an optical scanning apparatus 50 configured to form an electrostatic latent image on a photosensitive body 32 of the developing apparatus 30, a setting apparatus 80 configured to set the toner image transferred to the printing medium S on the printing medium S, and a printing medium discharge apparatus 70 configured to discharge the printing medium S, on which the image is completely formed, to the outside of the main body 10.

The printing medium supplying apparatuses 20 and 100 configured to store and feed the printing medium S are provided at a lower section of the main body 10 to supply the printing medium S toward the developing apparatus 30.

The printing medium supplying apparatuses include a cassette type printing medium supplying apparatus 100 configured to store the printing medium S and be detachable from the main body 10, and a tray type printing medium supplying apparatus 20 pivotally installed at the main body 10.

The cassette type printing medium supplying apparatus 100 may include a supply cassette 110, a printing medium supply unit 110*a* in which the printing medium S is stocked in the supply cassette 110, and a conveyance member 25 configured to pick up the printing media S stored in the printing medium supply unit 110*a* and convey the printing media S toward the developing apparatus 30 one by one.

A knock-up plate 120 having one end pivotally provided and supported by a lifting unit 130 may be installed in the printing medium supply unit 110*a* to guide the stacked printing media S toward the conveyance member 25.

The conveyance member 25 may include a pick-up roller 27 configured to pick up the printing media S stacked on the knock-up plate 120 one by one, and a feed roller 28 configured to convey the printing medium S picked up by the pick-up roller 27 toward the developing apparatus 30.

The printing medium supplying apparatus 100 will be described below in detail.

The developing apparatus 30 includes a housing 31 forming an exterior, the photosensitive body 32 rotatably coupled to the inside of the housing 31 to form an electrostatic latent image, agitating screws 33*a* and 33*b* configured to agitate toner supplied from the toner apparatus 40, a developing roller 34 configured to supply the toner agitated by the agitating screws 33*a* and 33*b* to the photosensitive body 32, and an electrical charging member 35 configured to electrically charge the photosensitive body 32.

The toner supplied from the toner apparatus 40 is introduced into the housing 31 to be agitated by the agitating screws 33*a* and 33*b* and conveyed toward one side of the housing 31, and the agitated and conveyed toner is supplied to the photosensitive body 32 by the developing roller 34 to form a visual image.

The photosensitive body 32 comes in contact with a transfer roller 14 to form a transfer nip N1 such that the toner supplied to the photosensitive body 32 to form the visual image is transferred to the printing medium S. The transfer roller 14 is rotatably disposed in the main body 10.

The toner apparatus 40 is coupled to the developing apparatus 30, accommodates and stores the toner for forming an image on the printing medium S, and supplies the toner to the developing apparatus 30 when an image forming operation is performed.

The optical scanning apparatus 50 transmits scanned light including image information to the photosensitive body 32 to form an electrostatic latent image on the photosensitive body 32.

The setting apparatus 80 applies heat and pressure to the printing medium S to set the toner image formed on the printing medium S on the printing medium S. A structure of the setting apparatus 80 will be described below in detail.

The printing medium discharge apparatus 70 includes a first discharge roller 71 and a second discharge roller 72, which are sequentially installed, to discharge the printing medium S passing through the setting apparatus 80 to the outside of the main body 10.

A guide rib 16 configured to guide the printing medium S passing through the transfer nip N1 to the setting apparatus 80 is disposed between the transfer nip N1 and the setting apparatus 80. The guide rib 16 forms a portion of a conveyance path P of the printing medium S between the transfer nip N1 and the setting apparatus 80.

Figure 2:
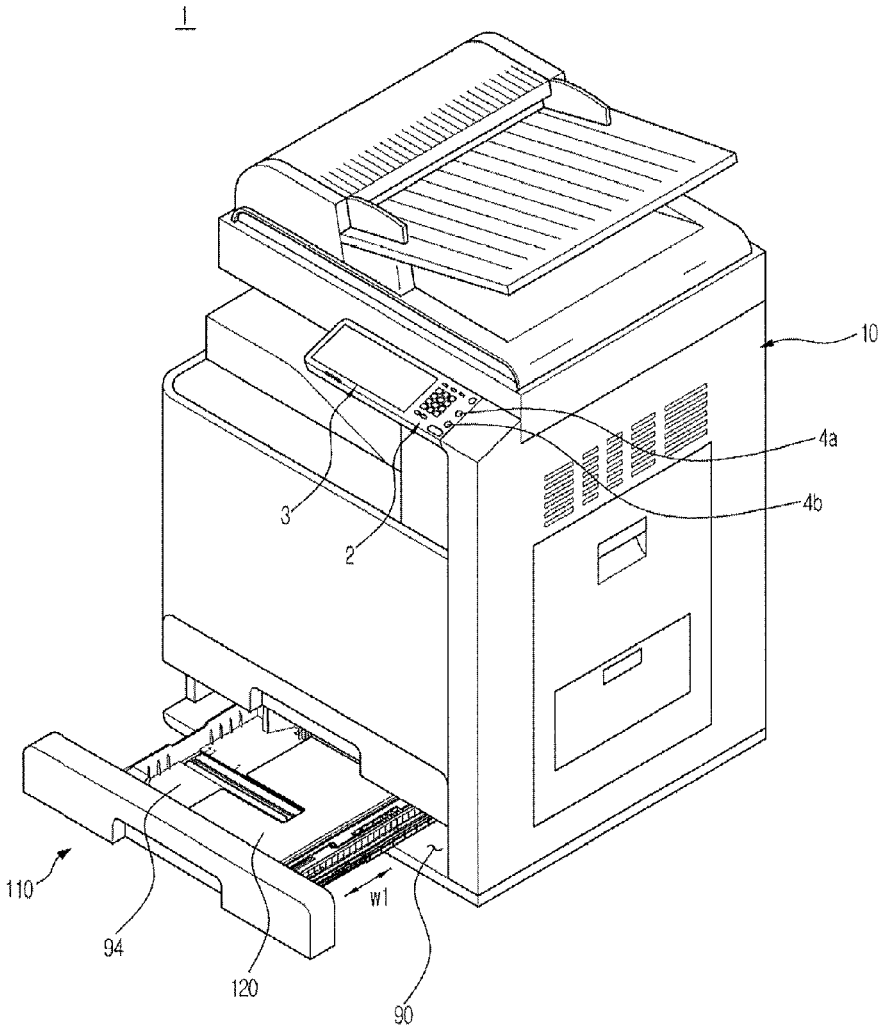
FIG. 2 is a perspective view of the image forming apparatus according to the embodiment.
Figure 3A:
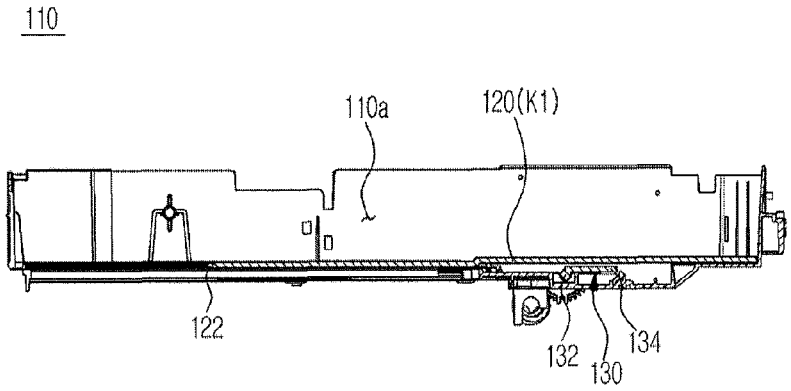
FIGS. 3A and 3B are views for describing an operation of a printing medium supplying apparatus of the image forming apparatus according to an embodiment.
Figure 3B:
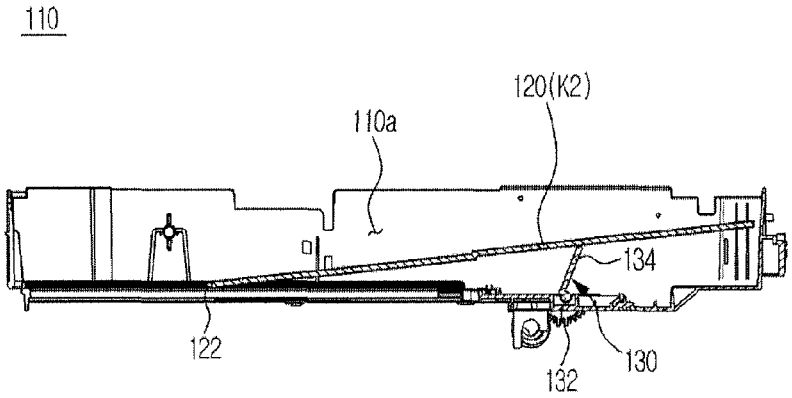

FIG. 2 is a perspective view of the image forming apparatus according to an embodiment, and FIGS. 3A and 3B are views for describing an operation of the printing medium supplying apparatus of the image forming apparatus according to an embodiment.

The printing medium supplying apparatus 100 may include the supply cassette 110 and the knock-up plate 120.

The supply cassette 110 is provided to stack the printing media S. The supply cassette 110 has a space in which the printing media S supplied into the main body 10 are stacked, and is provided to be inserted into or separated from the main body 10.

The supply cassette 110 may be formed in a rectangular plate shape having an open upper surface through which papers can be stacked. The supply cassette 110 is configured to be detachable from a cassette mounting section 90 such that a user can supply papers.

The supply cassette 110 includes a cassette bottom surface 94 forming a bottom surface thereof.

The knock-up plate 120 is installed on the cassette bottom surface 94, and the printing media S are stacked on a surface of the plate. The knock-up plate 120 has one end section extending from a central region of the supply cassette 110 and the other end section extending to one surface of the supply cassette 110. The knock-up plate 120 has a plate hinge section 122 provided at the one end section to be pivotable with respect to the supply cassette 110.

The knock-up plate 120 can be pivoted by the plate hinge section 122 between a standby position K1 in contact with the cassette bottom surface 94 such that a user can easily stack the printing media S, and a supply position K2 at which a pick-up roller can pick up the printing medium S. The knock-up plate 120 is maintained at the standby position K1 while being separated from the cassette mounting section 90, and is pivotally supported at the supply position K2 when mounted on the cassette mounting section 90.

Elevation of the knock-up plate 120 can be performed by the lifting unit 130. The lifting unit 130 is disposed under the knock-up plate 120 and provided to support elevation of the knock-up plate 120.

The lifting unit 130 may include a lifting hinge section 132 and a lifting plate 134.

The lifting hinge section 132 is provided to be rotatable by receiving power by a driving source 162, a power control apparatus 164 and intermediate gears 168, which will be described below, and the lifting plate 134 is provided to be pivotable by rotation of the lifting hinge section 132.

The lifting hinge section 132 may be provided at the one end section of the lifting plate 134, and the other end section may be provided to support a lower section of the knock-up plate 120.

Movement of the knock-up plate 120 between the standby position K1 and the supply position K2 according to a stacking amount of the printing media S or elevation according to the stacking amount of the printing media S can be performed through rotation of the lifting unit 130.

Figure 4:
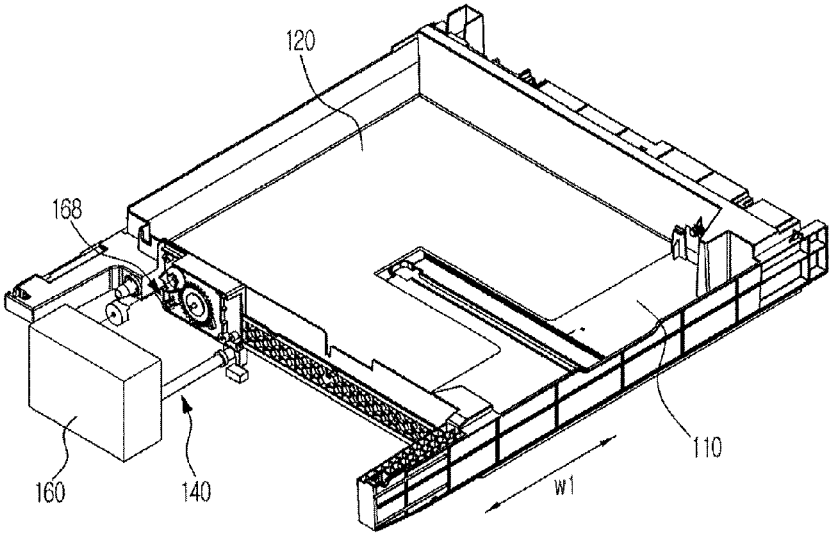
FIG. 4 is a perspective view showing the printing medium supplying apparatus of the image forming apparatus according to an embodiment.
Figure 5:
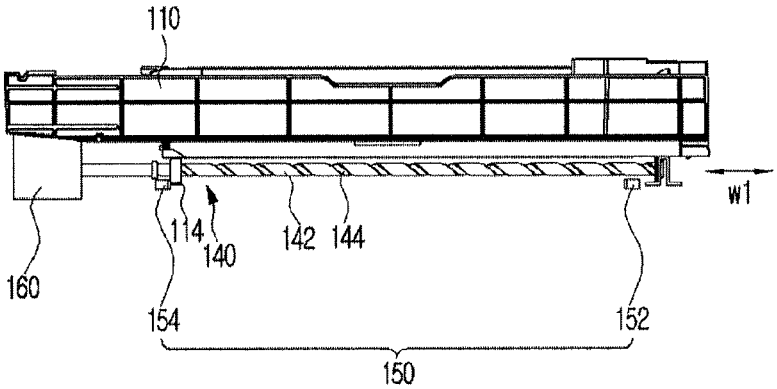
FIG. 5 is a side view of the printing medium supplying apparatus of the image forming apparatus according to an embodiment.
Figure 6:
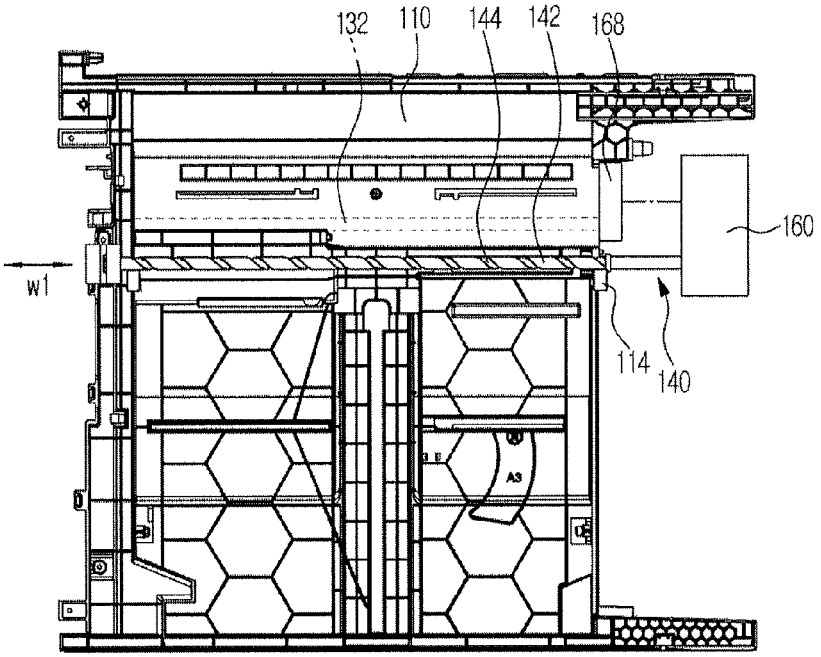
FIG. 6 is a front view of the printing medium supplying apparatus according to an embodiment, when seen from below.
Figure 7:
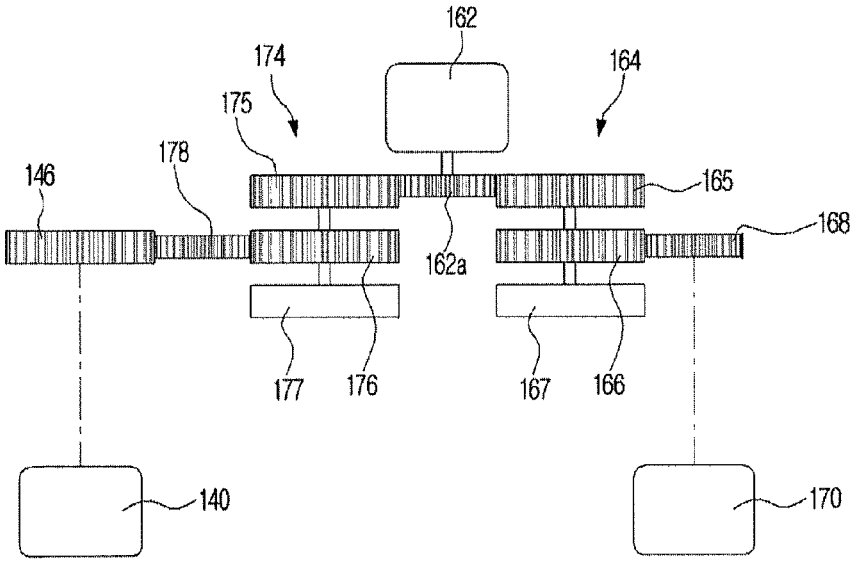
FIG. 7 is a view schematically showing a driving unit of the image forming apparatus according to an embodiment.
Figure 8:
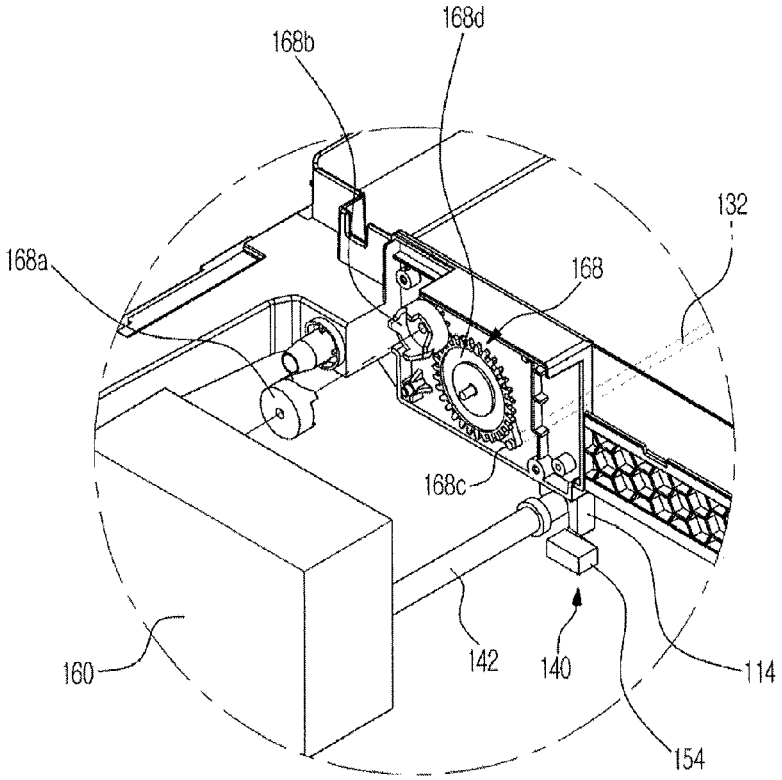
FIG. 8 is an enlarged perspective view of a partial configuration of the printing medium supplying apparatus according to an embodiment.

FIG. 4 is a perspective view showing the printing medium supplying apparatus of the image forming apparatus according to an embodiment, FIG. 5 is a side view of the printing medium supplying apparatus of the image forming apparatus according to the embodiment of the present invention, FIG. 6 is a front view of the printing medium supplying apparatus according to an embodiment, when seen from below, FIG. 7 is a view schematically showing a driving unit of the image forming apparatus according to an embodiment, and FIG. 8 is an enlarged perspective view of a partial configuration of the printing medium supplying apparatus according to an embodiment.

An opening/closing unit 140 is configured to open and close the supply cassette 110. The opening/closing unit 140 is configured to selectively receive power from a driving unit 160 (to be described below) to move the supply cassette 110 back and forth.

The opening/closing unit 140 includes a guide unit 142 and a guide rail 144.

The guide unit 142 is provided to guide advance and retreat of the supply cassette 110.

The guide unit 142 is provided to extend in a first axis w1 direction parallel to a side surface of the supply cassette 110 to be rotatable. The first axis w1 direction may be the same as a forward and rearward direction of the supply cassette 110. The guide unit 142 may have the guide rail 144 formed in a spiral shape on an outer surface thereof and configured to guide movement of the supply cassette 110 by rotation of the guide unit 142.

The supply cassette 110 may include a movable protrusion 112 protruding to move along the guide rail 144. The movable protrusion 112 is provided to move along the guide rail 144 by rotation of the guide unit 142, and the supply cassette 110 is provided to advance and retreat through movement of the movable protrusion 112.

The driving unit 160 is provided to generate power. The power generated from the driving unit 160 is transmitted to a driven unit 170.

A configuration of the driving unit 160 is not limited, and an embodiment includes the driving source 162 and the power control apparatus 164 configured to control the power generated from the driving source 162. While the configuration of the driving source 162 is not limited, a motor is provided in an embodiment.

In an embodiment, the power control apparatus 164 includes a first control gear 165 connected to the driving source 162, a second control gear 166 configured to intermittently receive power from the first control gear 165, and a power control unit 167 configured to selectively transmit power between the first control gear 165 and the second control gear 166.

The power control unit 167 is configured to selectively transmit the power from the first control gear 165 to the second control gear 166. Specifically, when a power transmission gear 162*a* installed at the driving source 162 is rotated with driving of the driving source 162, the power is transmitted to the first control gear 165, and the power control unit 167 couples a shaft of the first control gear 165 and a shaft of the second control gear 166 or releases the coupling to intermittently transmit power to the second control gear 166.

A configuration and a type of the power control apparatus 164 are not limited thereto as long as the power generated from the driving source 162 can be controlled.

The intermediate gear 168 is disposed between the power control apparatus 164 and the driven unit 170 to transmit power from the power control apparatus 164 to the driven unit 170. The number or shape of the intermediate gears 168 is not limited.

The driven unit 170 is configured to receive power and be driven by the driving unit 160. In an embodiment, the driven unit 170 is exemplified as the lifting hinge section 132 of the knock-up plate 120 but is not limited thereto.

The driven unit 170 is the lifting hinge section 132 of the knock-up plate 120 in an embodiment, and in the case of a first position P1 at which the supply cassette 110 is inserted into the main body 10, may be provided to intermittently transmit power by the power control apparatus 164.

Specifically, the intermediate gear 168 connected from the power control apparatus 164 includes a first coupling gear 168*a*, and the first coupling gear 168*a* is configured to engage with a second coupling gear 168*b* provided at the supply cassette 110. The first coupling gear 168*a* and the second coupling gear 168*b* are provided to couple to each other only when the supply cassette 110 is positioned at the first position P1 of insertion into the main body 10.

The lifting hinge section 132 has a lifting gear 168*c* provided at an end section thereof, and the lifting hinge section 132 is provided to be rotated by rotation of the lifting gear 168*c*. A shifting gear 168*d* configured to change a rotational speed is installed between the lifting gear 168*c* and the second coupling gear 168*b*.

The driving unit 160 may include an opening/closing power control apparatus 174.

The opening/closing power control apparatus 174 is configured to control power transmitted from the driving source 162 to the opening/closing unit 140. The opening/closing power control apparatus 174 and the power control apparatus 164 may be independently configured, and provided to be connected to the power transmission gear 162*a* of the driving source 162 in an embodiment.

While the opening/closing power control apparatus 174 and the power control apparatus 164 are configured to be simultaneously operated, in the embodiment, these apparatuses may be selectively operated or may perform a plurality of different operations from the same driving source 162.

For example, the knock-up plate 120 moves between the standby position K1 and the supply position K2 when the supply cassette 110 is disposed at the first position P1, and the operation of the knock-up plate 120 is stopped when the supply cassette 110 is at a second position P2 or the knock-up plate 120 moves between the first position P1 and the second position P2.

The opening/closing power control apparatus 174 includes a first opening/closing control gear 175 connected to the driving source 162, a second opening/closing control gear 176 configured to intermittently receive power from the first opening/closing control gear 175, and an opening/closing power control unit 177 configured to selectively transmit power between the first control gear 165 and the second control gear 166.

The opening/closing power control unit 177 is provided to selectively transmit power from the first opening/closing control gear 175 to the second opening/closing control gear 176. Specifically, when the power transmission gear 162*a* installed at the driving source 162 is rotated with driving of the driving source 162, the power is transmitted to the first opening/closing control gear 175, and the opening/closing power control unit 177 couples a shaft of the first opening/closing control gear 175 and a shaft of the second opening/closing control gear 176 or releases the coupling to intermittently transmit power to the second opening/closing control gear 176.

The configuration and type of the opening/closing power control apparatus 174 are not limited as long as the power generated from the driving source 162 can be controlled. The power control apparatus 164 configured to intermittently transmit power to the driven unit 170 and the opening/closing power control apparatus 174 configured to intermittently transmit power to the opening/closing unit 140 may be referred to as a first power control apparatus 164 and a second power control apparatus 174, respectively.

A guide gear 146 configured to receive the power intermittently transmitted by the opening/closing power control unit 177 may be provided at the end section of the guide unit 142. The guide gear 146 may be included in the driving unit 160.

The guide gear 146 may be provided to directly engage with the second opening/closing control gear 176 of the opening/closing power control unit 177, or may receive power through an intermediate gear 178 disposed between the second opening/closing control gear 176 and the guide gear 146. The guide unit 142 is provided to receive power from the guide gear 146 to be axially rotated.

The opening/closing unit 140 includes movement detecting sensors 150 configured to detect an opening/closing level of the supply cassette 110.

The movement detecting sensors 150 are disposed on the guide unit 142, and configured to detect a position of the supply cassette 110.

In an embodiment, the pair of movement detecting sensors 150 are provided on the guide unit 142. Specifically, the movement detecting sensors 150 may include a rearward movement detecting sensor 154 configured to detect the first position P1 at which the supply cassette 110 is inserted into the main body 10, and a forward movement detecting sensor 154 configured to detect the second position P2 at which the supply cassette 110 is separated from the main body 10.

A position of the supply cassette 110 is detected by the movement detecting sensors 150, the detected position is transmitted to a control unit (not shown), and an order related to an operation of the supply cassette 110 is issued from the control unit (not shown). The configuration and type of the movement detecting sensors 150 are not limited as long as the operation or position of the supply cassette 110 can be detected.

Figure 9:
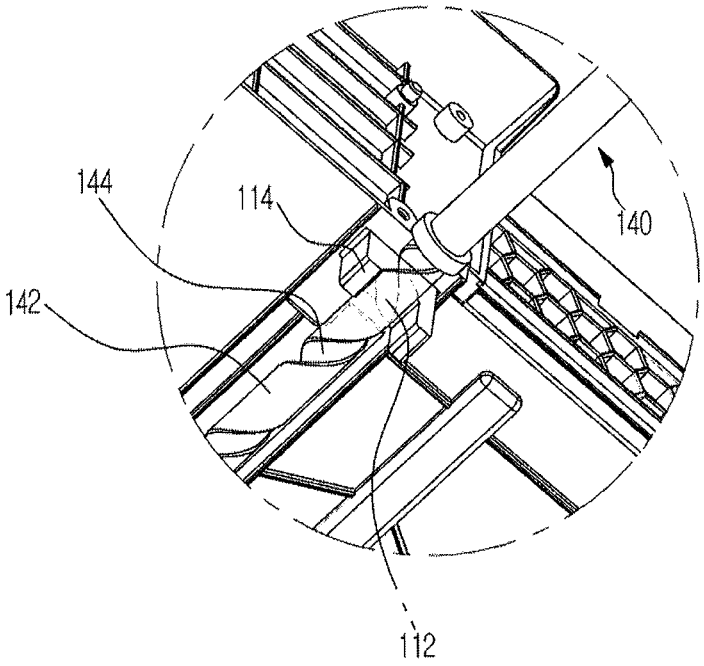
FIG. 9 is an enlarged perspective view of a partial configuration of an opening/closing apparatus according to an embodiment.

FIG. 9 is an enlarged perspective view of a partial configuration of an opening/closing apparatus according to an embodiment.

The movable protrusion 112 is provided to protrude from the supply cassette 110 to correspond to a width of the guide rail 144, and a shape thereof is not limited. In the embodiment, the movable protrusion 112 corresponds to a spiral shape of the guide rail 144 and protrudes to be inserted into a partial section of the guide rail 144. In addition, anti-separation ribs 114 are provided at both sides of the movable protrusion 112 to prevent the movable protrusion 112 from being separated from the guide rail 144. The pair of anti-separation ribs 114 may be provided to be spaced a width of the guide unit 142 from each other. The configurations and shapes of the movable protrusion 112 and the anti-separation rib 114 are not limited as long as the supply cassette 110 can be moved by the opening/closing unit 140.

A side portion of the guide unit 142 is guided by the anti-separation rib 114, and an upper portion of the guide unit 142 is provided to come in contact with the movable protrusion 112. A lower portion of the guide unit 142 is provided to be opened such that the supply cassette 110 can be separated from the guide unit 142.

An operation of the printing medium supplying apparatus and the image forming apparatus having the same according to an embodiment will be described below.

Figure 10A:
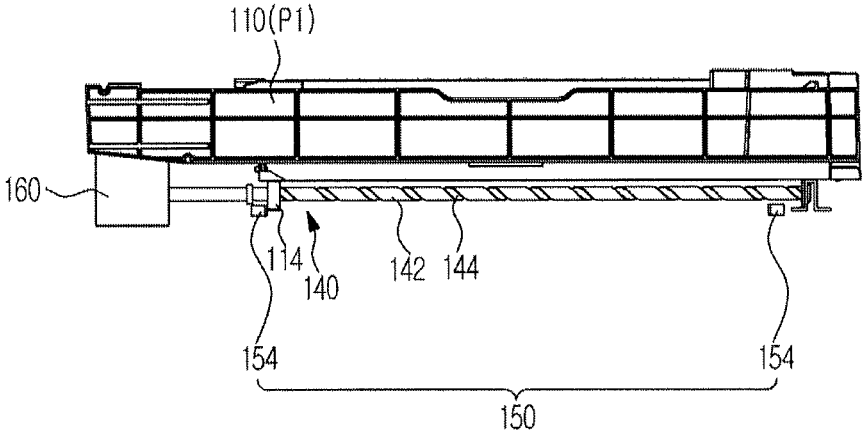
FIGS. 10A and 10B are views showing an opening/closing operation of the printing medium supplying apparatus according to an embodiment.
Figure 10B:
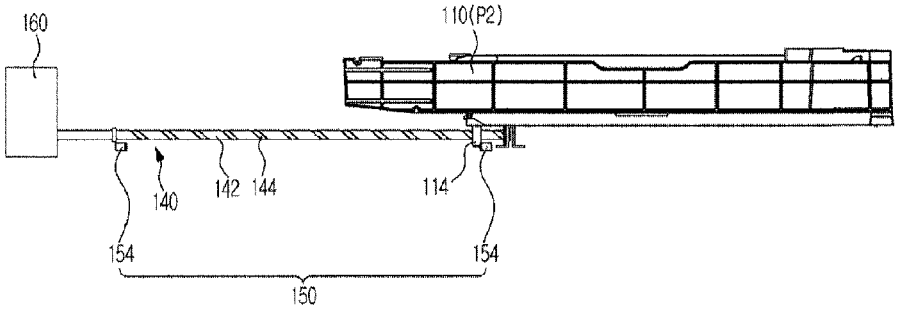

FIGS. 10A and 10B are views showing an opening/closing operation of the printing medium supplying apparatus according to an embodiment.

The supply cassette 110 is provided to be movable between the first position P1 of insertion into the main body 10 and the second position P2 of separation from the main body 10 to stack the printing medium S, and the guide rail 144 guides the movable protrusion 112 to be movable between the first position P1 and the second position P2. That is, the opening/closing unit 140 is provided to guide movement of the supply cassette 110 such that the supply cassette 110 is completely opened and completely closed. The rearward movement detecting sensor 154 detects that the supply cassette 110 is positioned at the first position P1. When an order of opening the supply cassette 110 is input through the control unit (not shown), power of the driving source 162 is transmitted to the opening/closing unit 140 by the opening/closing power control apparatus 174.

The movable protrusion 112 is moved forward along the guide rail 144 by rotation of the guide unit 142, and the supply cassette 110 moves from the first position P1 to the second position P2.

Figure 11:
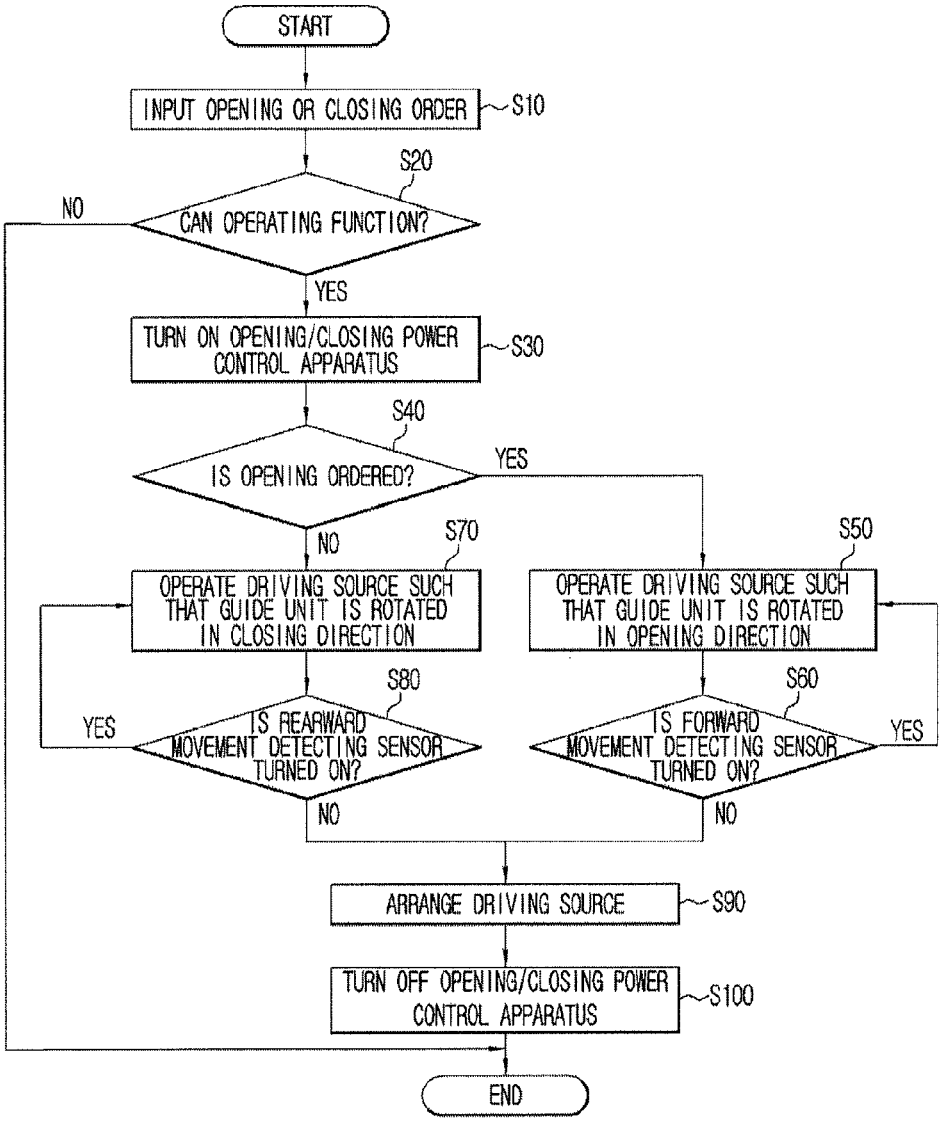
FIG. 11 is a flowchart showing an operation of the printing medium supplying apparatus according to an embodiment.

FIG. 11 is a flowchart showing an operation of the printing medium supplying apparatus according to an embodiment.

Opening or closing of the supply cassette 110 is input through an input unit provided at the main body 10 (S10). Then, the control unit (not shown) detects whether the supply cassette 110 is currently positioned at the first position P1 or the second position P2, and determines whether the supply cassette 110 can be operated (S20). When the opening order is issued at the second position P2 or the closing order is issued at the first position P1, the order is terminated (end), and when the opening order is issued at the first position P1 or the closing order is issued at the second position P2, the opening/closing power control apparatus 174 is turned ON (S30).

When the order is determined as the opening order (S40), the driving source 162 is operated such that the guide unit 142 is rotated in an opening direction (S50). It is determined whether the forward movement detecting sensor 152 is turned ON (S60), when OFF, the guide unit 142 is operated to be continuously rotated, and when ON, the operation of the driving source 162 is stopped (S90).

When the order is determined as the closing order (S40), the driving source 162 is operated such that the guide unit 142 is rotated in a closing direction (S70). It is determined whether the rearward movement detecting sensor 154 is turned ON (S80), when OFF, the guide unit 142 is operated to be rotated, and when ON, the operation is stopped (S90). The opening/closing power control apparatus 174 is turned OFF (S100), and the operation is terminated (end).

In operation (S10) of inputting the opening or closing order of the supply cassette 110, the order can be input through an opening button 4*a* and a closing button 4*b* of an input unit 2 provided at the image forming apparatus 1.

The shape and disposition of the opening button 4*a* and the closing button 4*b* are not limited. Like in the embodiment, the opening button 4*a* and the closing button 4*b* may be separately provided at the input unit 2, or the opening or closing order may be input through a touch screen 3 provided at the input unit 2. The embodiment is not limited thereto, and the opening button and the closing button may be directly provided at the supply cassette 110. The opening button and the closing button may be separately provided, or one button may be provided such that the opening order or the closing order may be alternately input whenever the one button is pushed.

As is apparent from the above description, the printing medium supplying apparatus and the image forming apparatus having an embodiment can automatically open and close the supply cassette for stacking the printing media to provide user convenience, and prevent the stacked printing media from being disordered due to an impact.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a main body having a developing apparatus;

a driving source configured to generate power within the main body;

a supply cassette configured to be detachable from the main body and in which printing media are stacked;

a knock-up plate configured to elevate the printing media in the supply cassette and configured to receive the power from the driving source to be operated;

an opening/closing unit configured to receive the power from the driving source and configured to move the supply cassette back and forth;

an opening/closing power control apparatus configured to control the power transmitted from the driving source to the opening/closing unit; and a power control apparatus configured to control the power transmitted from the driving source to the knock-up plate, wherein the power control apparatus and the opening/closing power control apparatus are independently operated, wherein the power control apparatus comprises:

a first control gear connected to the driving source;

a second control gear configured to intermittently receive power from the first control gear; and a power control unit configured to selectively transmit power between the first control gear and the second control gear.

2. The image forming apparatus according to claim 1, wherein:

the power control apparatus is configured to intermittently transmit power from the driving source to the knock-up plate, the supply cassette is configured to be movable between a first position of insertion into the main body and a second position of separation from the main body to stack the printing media, and the power control apparatus controls the power to the knock-up plate when the supply cassette is at the first position.

3. The image forming apparatus according to claim 1, wherein:

the supply cassette is configured to be movable between a first position of insertion into the main body and a second position of separation from the main body to stack the printing media, and the opening/closing power control apparatus controls the power to the opening/closing unit so that the supply cassette is movable between the first position and the second position.

4. The image forming apparatus according to claim 1, wherein the opening/closing unit comprises:

a guide unit which extends from a side surface of the supply cassette in a first axis direction parallel to a forward and rearward direction to be rotated; and a guide rail which is formed at an outer surface of the guide unit in a spiral shape and which is configured to guide movement of the supply cassette through rotation of the guide unit.

5. The image forming apparatus according to claim 4, wherein the supply cassette comprises a movable protrusion which protrudes to move the supply cassette along the guide rail.

6. The image forming apparatus according to claim 5, wherein:

the supply cassette is configured to be movable between a first position of insertion into the main body and a second position of separation from the main body, and the guide rail guides the movable protrusion so that the supply cassette is movable between the first position and the second position.

7. The image forming apparatus according to claim 4, wherein the opening/closing unit further comprises a movement detecting sensor provided on the guide unit and configured to detect opening/closing of the supply cassette.

8. An image forming apparatus comprising:

a main body having a developing apparatus;

a supply cassette configured to be detachable from the main body and in which printing media are stacked;

a knock-up plate configured to elevate the printing media in the supply cassette;

an opening/closing unit configured to move the supply cassette back and forth to open and close the supply cassette; and a driving unit configured to operate the knock-up plate and the opening/closing unit, wherein the driving unit comprises:

a driving source configured to generate power;

a first power control apparatus configured to control the power transmitted from the driving source to the knock-up plate; and a second power control apparatus configured to control the power transmitted from the driving source to the opening/closing unit, wherein the first power control apparatus and the second power control apparatus are independently operated, wherein the supply cassette is provided to be movable between a first position of insertion into the main body and a second position of separation from the main body, wherein the first power control apparatus includes:

a first coupling gear; and a second coupling gear provided at the supply cassette and selectively coupled to the first coupling gear when the supply cassette is at the first position, and wherein the first power control apparatus transmits power to the knock-up plate by having the first coupling gear engaged with the second coupling gear when the supply cassette is at the first position.

9. The image forming apparatus according to claim 8, wherein:

the supply cassette is provided to be movable between a first position of insertion into the main body and a second position of separation from the main body to stack printing media, and the second power control apparatus is configured to transmit power to the opening/closing unit such that the supply cassette is movable between the first position and the second position.

10. The image forming apparatus according to claim 8, wherein the first power control apparatus and the second power control apparatus are alternatively operated.

11. A printing medium supplying apparatus provided to be separable from a main body to supply printing media, the printing medium supplying apparatus comprising:

a supply cassette provided to be movable between a first position of insertion into the main body and a second position of separation from the main body to stack the printing media;

a driving unit having a driving source configured to generate power and an opening/closing power control apparatus configured to selectively transmit power from the driving source;

an opening/closing unit configured to selectively receive power from the opening/closing power control apparatus and configured to move the supply cassette between the first position and the second position; and a knock-up plate configured to elevate the printing medium stacked on the supply cassette, wherein the driving unit further comprises an elevation power control apparatus configured to receive power from the driving source to elevate the knock-up plate, wherein the opening/closing power control apparatus and elevation power control apparatus are independently operated, and wherein the opening/closing unit comprises:

a guide unit which extends from a side surface of the supply cassette in a first axis direction parallel to a forward and rearward direction to be rotated; and a guide rail formed on an outer surface of the guide unit in a spiral shape and configured to guide movement of the supply cassette by rotation of the guide unit.

12. The printing medium supplying apparatus according to claim 11, wherein the supply cassette comprises a movable protrusion protruding to move along the guide rail.

13. The printing medium supplying apparatus according to claim 12, wherein:

the supply cassette is provided to be movable between the first position of insertion into the main body and the second position of separation from the main body to stack the printing media, and the guide rail guides the movable protrusion so that the supply cassette is movable between the first position and the second position.

14. The printing medium supplying apparatus according to claim 11, wherein the opening/closing unit further comprises a movement detecting sensor provided on the guide unit and configured to detect opening/closing of the supply cassette.

* * * * *